US005869437A

United States Patent [19]

Wolfersberger

[11] Patent Number: 5,869,437

[45] Date of Patent: Feb. 9, 1999

[54] TRANSPARENT SOAP WITH DISSOLVABLE LOGO

[76] Inventor: Donna J. Wolfersberger, 5612 Summerside Trail, St. Louis, Mo. 63128

[21] Appl. No.: 739,462

[22] Filed: Oct. 29, 1996

[51] Int. Cl.[6] ..... C11D 17/00; C11D 17/04; C11D 9/00

[52] U.S. Cl. ..... 510/147; 510/143; 510/440; 510/483

[58] Field of Search ..... 510/142, 143, 510/147, 440, 449, 475

[56] References Cited

U.S. PATENT DOCUMENTS

| | | | |
|---|---|---|---|
| 108,584 | 10/1870 | George . | |
| 165,628 | 7/1875 | Strunz | 510/147 |
| 648,247 | 4/1900 | Dunne . | |
| 1,441,315 | 2/1923 | Walbridge . | |
| 1,707,334 | 11/1929 | Unfried . | |
| 1,764,009 | 6/1930 | Embree | 510/147 |
| 1,827,549 | 10/1931 | Villain | 510/147 |
| 1,997,474 | 4/1935 | Stone . | |
| 2,051,625 | 8/1936 | Watt | 510/147 |
| 3,149,188 | 9/1964 | Schmitt | 264/267 |
| 3,294,692 | 12/1966 | Kelly et al. . | |
| 3,413,229 | 11/1968 | Bianco et al. | 252/90 |
| 3,413,230 | 11/1968 | Dupuis | 252/92 |
| 3,432,325 | 3/1969 | Hideshige Haba . | |
| 3,531,828 | 10/1970 | Nauta . | |
| 3,773,672 | 11/1973 | Bredice | 252/92 |
| 3,923,438 | 12/1975 | Peria . | |
| 4,078,482 | 3/1978 | Goerig et al. . | |
| 4,165,293 | 8/1979 | Gordon | 252/118 |
| 4,201,743 | 5/1980 | Perla et al. . | |
| 4,277,358 | 7/1981 | Hopkins | 252/92 |
| 4,297,228 | 10/1981 | Kamada et al. . | |
| 4,318,878 | 3/1982 | Hornig . | |
| 4,438,010 | 3/1984 | Lindauer et al. . | |
| 4,453,909 | 6/1984 | Linaurer . | |
| 4,504,433 | 3/1985 | Inui et al. | 264/232 |
| 5,198,198 | 3/1993 | Gladfelter et al. | 422/264 |
| 5,472,545 | 12/1995 | Malki . | |
| 5,529,714 | 6/1996 | Tokosh | 252/108 |
| 5,603,691 | 2/1997 | Scholz et al. | 602/8 |

FOREIGN PATENT DOCUMENTS

| | | |
|---|---|---|
| 835913 | 3/1970 | Canada . |
| 881767 | 11/1961 | United Kingdom . |

*Primary Examiner*—Paul Lieberman
*Assistant Examiner*—John M. Petruncio
*Attorney, Agent, or Firm*—Polster, Lieder, Woodruff & Lucchesi LC

[57] ABSTRACT

A transparent cleansing bar having a logo or other design or message printed on a dissolvable polymer material embedded at approximately the mid-point of the bar. The message is printed on both sides of a very thin sheet of dissolvable plastic material. The bar is formed from transparent modified soap material. The printed sheet is positioned between the two halves of the bar which form the transparent bar having the printed message at the midpoint. The message is viewable through the transparent bar. Upon normal use, the surface of the bar wears away. When the bar is worn or wasted to the midpoint and the printed polymer sheet is exposed to water, the printed sheet dissolves to avoid any disposal problems. An improved method for forming the transparent cleansing bar with a dissolvable, printable film also is disclosed.

8 Claims, 2 Drawing Sheets

TRANSPARENT SOAP WITH DISSOLVABLE LOGO

This application is related to application Ser. No. 08/741,853, filed Oct. 29, 1996, for which has a common inventor.

BACKGROUND OF THE INVENTION

This invention relates generally to skin cleanser and more particularly, to a transparent bar skin cleanser bearing an internal, dissolvable printed logo that can be offered as an advertising premium.

Bar soaps are well known to the art. Traditional soaps are salts of fatty acids prepared mainly by reacting fats with caustic alkali through a process known as saponification. The treatment of fat with alkali to make traditional soap has been practiced for at least 5000 years.

Conventional toilet bar soaps use higher quality fats and the water content is reduced. Warm molten soap, including perfumes and other additives, is made into flakes and then milled. The milled flakes pass to a plodding machine which works the flakes and compacts the worked soap into bar form. The bars then are cut and stamped to their final shape.

Other modified soaps can be formed into a bar shape and commonly referred to as "soap" by consumers, even though they are not formed totally from fat and alkali through the traditional saponification process. One such common product is Neutrogena® Soap (Neutrogena Corp.), which is a transparent, nondetergent modified bar soap including triethanolamine, stearic acid, tallow, glycerin, coconut oil, castor oil, sodium hydroxide, oleic acid and cocamide DEA. Another is Basis™ Glycerin Soap (Beiersdorf), which is a transparent modified bar soap including tallow, coconut oil and glycerin. These products generally are indicated for people with sensitive, dry or irritated skin who may not tolerate common soap products.

Besides functioning primarily as cleansers, bar soaps, both conventional and modified, generally are provided in aesthetically pleasing forms. The products include perfumes and fragrances and usually are provided in attractive packaging. Often, the bar soaps are impressed with designs so as to render them decorative or aesthetically pleasing. Moreover, the soap bars often serve as advertising vehicles for their manufacturers. The manufacturer's name and trademarks generally are printed directly on the wrap and packaging. Furthermore, the manufacturer includes the trademark or company name on the soap bar itself. That is, most commonly, the name of the soap or company is molded or stamped into the bar of soap. This molding or stamping of the company or product name into the product serves as a source of company and product advertising at least until use of the soap bar under normal bathing or washing conditions wears the company and product name from the soap bar.

Further, the desire to have a company name or product name affixed to a soap bar is not limited to the manufacturer of the soap. For example, large hotel and motel chains provide complimentary soap in their rooms, the soap having the name or the hotel chain stamped or molded into the surface of the bar soap. Other concerns, such as trendy restaurants, gambling casinos and amusement parks have been known to offer such decorated or labeled bar soap for sale in gift shops as premium souvenirs. Thus, there is an incentive to provide a high quality, resilient printed or decorated bar soap with a relatively long-lasting design or.

Prior art patents have addressed the desire to decorate or label soap. For example, U.S. Pat. No. 3,432,325, to Haba, discloses a process for printing on soap. U.S. Pat. No. 4,078,482, to Goerig et al., discloses a method of embossing an indicia on soap with an elastomeric coated printing head. Further, U.S. Pat. No. 4,297,228, to Kamada et al., teaches a soap with a decorated surface and a method for decorating the soap. U.S. Pat. No. 5,472,545, to Maiki, provides a method for affixing labels to soap bars.

The conventional methods for labeling bars of soap all suffer from the same drawbacks. First, conventional stamping, embossing or molding results in a superficial decoration formed from the soap which quickly deteriorates or wastes as the soap is used. Moreover, this type of decoration is limited. The design or lettering either is cut or stamped into the soap or consists of raised soap material. Thus, the design necessarily is of the same color and texture as the soap. This type of embossing or etching does not allow for the use of varied, unique, colored or stylized print or design.

Further, the methods of labeling or decorating soap disclosed in the patents discussed above all produce a superficial label, printing or design. Although some of the prior art methods are an attempt at forming a long lasting design, if the soap is used for its intended purposes, the designs will deteriorate before the bar of soap is used up.

One attempt to provide a bar of soap bearing a design or printing that remains intact and readable until the bar of soap is used up is a bar soap having an imbedded, printed logo called "To Be", distributed by Dong Won Chemics, South Korea. The "To Be" soap is a dark amber, transparent bar having an embedded, printed message.

BRIEF SUMMARY OF THE INVENTION

It is among the principal objects of the present invention to provide a cleansing bar which includes a printed design that lasts and is readable and viewable nearly as long as the bar.

Another object of the invention is to provide such a cleansing bar that has a printed design within the bar so that the design lasts and is readable and viewable even as the surface of the bar deteriorates or wastes due to use.

Still another object of the invention is to provide such a cleansing bar that is transparent to allow the embedded design to be read or viewed through the bar.

Yet another object of the invention is to provide the design on a dissolvable material emmbedded in the transparent cleansing bar so that the design dissolves upon exposure to moisture when the bar is nearly used up so as to not create a disposal problem.

Another object of the invention is to provide the design on a printable, dissolvable material that will allow the printing of a broad array of designs in color.

Still another object of the invention is to provide a transparent cleansing bar having logo printed on dissolvable plastic material embedded in the bar that can be used as a premium advertising promotion.

A still further object of the invention is to provide an improved method for making the aforestated transparent cleansing bar with dissolvable, printable logo therein.

In accordance with the invention, a transparent cleansing bar having a logo or other design printed on a dissolvable plastic material embedded at approximately the mid-point of the bar is provided. The logo or design is printed on both sides of a very thin sheet of dissolvable plastic material. The bar is formed from transparent modified soap material in two halves. The printed sheet is placed between the two halves of the bar and then the halves are fused by pressure and heat to form the transparent bar having the printed logo or design at the midpoint. The logo or design is viewable through the transparent bar. Upon normal use, the surface of the bar wears away. When the bar is worn or wasted to the midpoint and the printed plastic sheet is exposed to water, the printed sheet dissolves to avoid any disposal problems.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
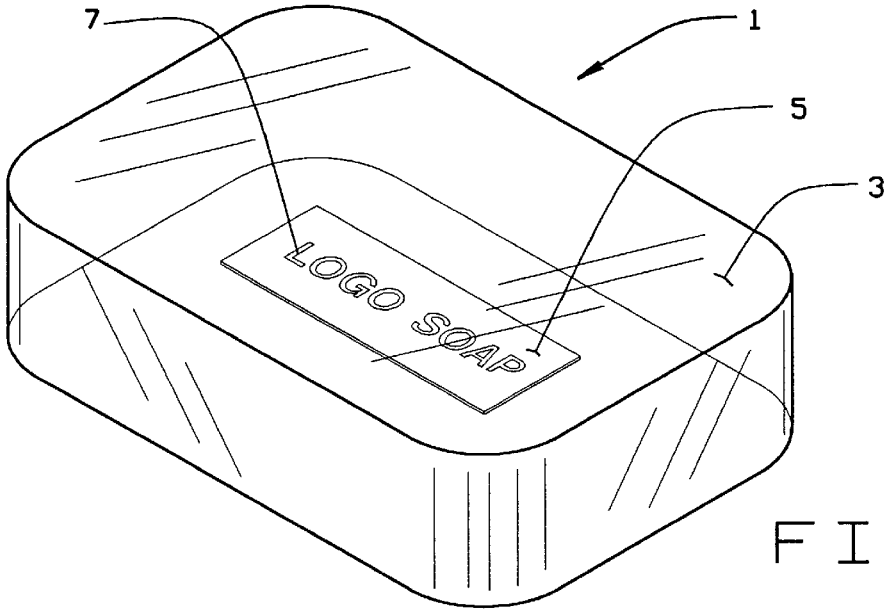
FIG. 1 is perspective view of the novel cleansing bar with a dissolvable, printed logo embedded therein.
Figure 2:
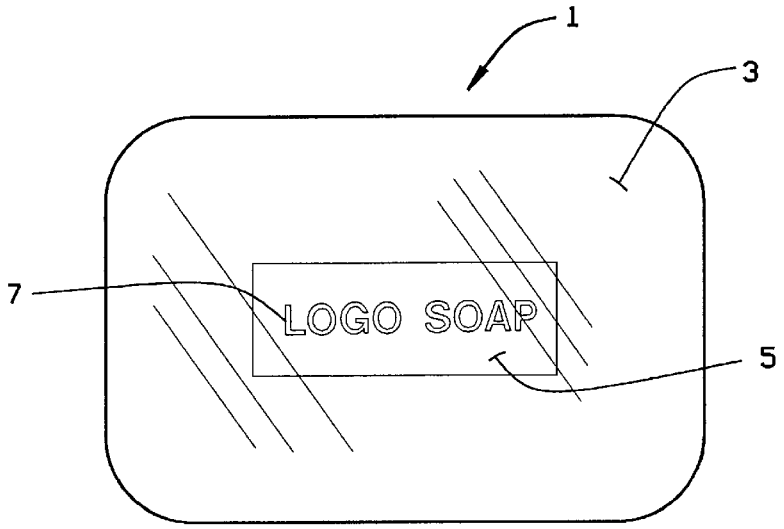
FIG. 2 is a top plan thereof.
Figure 3:
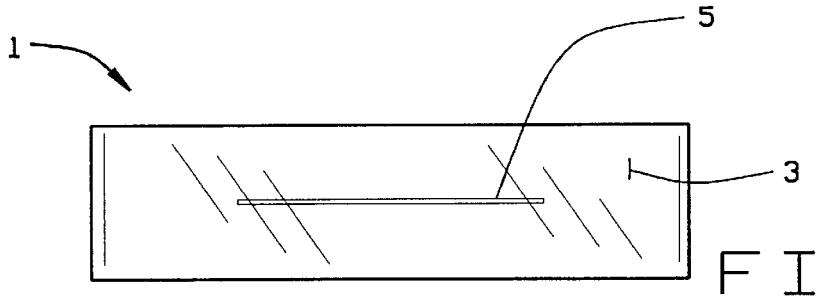
FIG. 3 is an end plan thereof.

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

A transparent cleansing bar bearing a dissolvable logo made in accordance with the principles of the present invention is indicated generally in the drawings by reference numeral 1. Bar 1 includes the transparent bar 3 and the dissolvable, printed sheet 5, both of which will be described in greater detail hereinafter.

Bar 1 is shown in the drawings as having an elongated conventional soap bar configuration. It will be appreciated, however, that bar 1 can be a cake of any desired configuration. That is, the cake can be formed or molded having a round or disc-shaped configuration or any other decorative or aesthetically pleasing shape or design such as a flower, shell or so on, without departing from the scope of the invention. It also will be appreciated that bar cleanser 1, whatever the configuration, can be referred to as a soap bar or soap cake.

Bar 1 is formulated to be transparent. The formulation of the transparent soap is the subject matter of co-pending application Ser. No. 08/741,853, filed Oct. 29, 1996, having a common inventor. The constituents of bar 1, when mixed as described below and molded into the desired configuration, is substantially clear allowing light to pass through it. The clarity of the bar is such that printed sheet 5 positioned at approximately the midpoint of bar 3 can be read without distortion of the printed message. The bar 3 may have a slight tint, such as a pale pastel coloring, i.e., pink, blue, amber and so on, but will retain its substantially clear "see-through" properties. The basic soap product to prepare bar 3 is prepared by following the procedure of Example 1:

| | | |
|---|---|---|
| Step A: | Propylene Glycol | 25.00% |
| | Sorbitol 70% | 25.75% |
| | Sodium Laureth Sulfate | 17.50% |

-continued

| | | |
|---|---|---|
| Step B: | Stearic Acid | 13.00% |
| | Myristic Acid | 6.00% |
| Step C: | Caustic Soda 50% | 6.00% |
| Step D: | Sodium Cocoyl Isethionate | 5.00% |
| | Triethanolamine | 1.00% |
| Step E: | Fragrance | 0.75% |

1. Add the ingredients of Step A to a mixing vessel. Begin heating and mixing.
2. Add the ingredients of Step B.
3. When the temperature reaches 140° F., slowly add the ingredients of Step C and mix for 10 minutes or until the soap is dissolved and the batch is uniform.
4. Add ingredients of Step D and mix for about 30 minutes or until the Sodium Cocoyl Isethionate goes into solution.
5. Discontinue mixing and let batch stand for a minimum of one hour. Ten minutes prior to the fill of the molds, add the fragrance and mix for 5 minutes.

Any desired amount of product can be made by increasing or decreasing the amounts of ingredients listed above, as long as the relative percentages are maintained. For example batches of 1000 lbs or more can be prepared. Further, an acceptable tint or dye may be added to give the soap a slight color or cast that does not interfere with the visualization of the printed logo.

Following the procedures of Example 1 will yield a liquefied translucent soap product with meets FDA requirements having a final formulation of the following Example 2:

| Ingredient | Quantity Range (% w/w) | Preferred Quantity (% w/w) |
|---|---|---|
| Propylene Glycol | 15 to 25 | 25.00 |
| Sorbitol | 15 to 25 | 18.03 |
| Water | 15 to 25 | 15.90 |
| Sodium Stearate | 10 to 20 | 14.95 |
| Sodium Lauryl Sulfate | 10 to 20 | 12.25 |
| Sodium Myristate | 2 to 6 | 7.12 |
| Sodium Cocoyl Isethionate | 2 to 6 | 5.00 |
| Triethanolamine | 0.5 to 3 | 1.00 |
| Fragrance | 0 to 2 | 0.75 |

Example 1 lists the raw ingredients before the chemical reaction that yields the product formulation of Example 2. For example, the stearic acid becomes sodium stearate upon chemical reaction with caustic soda. The water is provided through the raw ingredients. For example, both the sorbitol and sodium laureth sulfate contain 30% water and the caustic soda contains 50% water.

Although the formulation provided in Example 1 has proved to work well for this application, it will be appreciated that any other formulation of soap that produces an acceptably transparent of translucent cake may be used without departing from the scope of the invention.

As stated above, bar 1 includes a printed sheet as indicated by reference numeral 5. As shown, sheet 5 bears a printed message 7 which, in the figures, for illustration only, is shown as the inventor's trademark. It will be appreciated that message 7 is intended to include any printed words, design, logo, picture, insignia, advertising copy, trademark, service mark, business name and so forth as desired. It also will be appreciated that the printed matter, referred to hereinafter as "message" for ease and clarity of description, can be printed or drawn onto the sheet in any desired color or pattern. The resulting message is viewable and/or readable through bar 3 without significant distortion.

Sheet 5 is a dissolvable, printable polymer film that can be printed with any desired insignia. In the preferred embodiment, the film is transparent and is printed on one side but is viewable through the film and soap. However, the film can be printed on both sides. The same message can be on both sides or two different messages may be used. It will be appreciated that sheet 5 can be provided as small printed sheets for introduction into bar 3. Further, sheet 5 can be provided on large sheets which are printed with discrete insignia and then cut into the smaller sheet 5 or can be provided on narrow rolls for introduction into bar 3. In any event, the sheet 5 is introduced into bar 3 in a manner as will be described in detail below.

Sheet 5 is formed from a dissolvable, printable polymer film which is approximately 1 mil to 3 mil in thickness. One such commercially available film is the QSA 2000 series of films (Polymer Films Inc., Rockville, Conn.). QSA 2000, for example, is a fast dissolving, hot and cold water soluble film based on polyvinyl alcohol. It is a colorless, transparent solution cast film which is resistant to the action of most organic and inorganic chemicals. It has excellent stability to UV light and gas barrier properties. The properties of the QSA 2000 film are listed below in Table 1.

TABLE 1

| Typical Properties | | Relative Humidity 40% | 60% | 80% |
|---|---|---|---|---|
| Tensile Strength, psi | Machine Direction | 5000 | 4800 | 4200 |
| ASTM D882 | Transverse Direction | 4900 | 4800 | 4700 |
| Elongation, % | Machine Direction | 350 | 330 | 350 |
| ASTM D882 | Transverse Direction | 330 | 330 | 350 |
| 100% Modulus, psi | Machine Direction | 2260 | 2100 | 1500 |
| ASTM D882 | Transverse Direction | 2300 | 2000 | 1600 |
| Toughness, in-lb/in$^3$ | Machine Direction | 10000 | 8900 | 7600 |
| ASTM D882 | Transverse Direction | 9500 | 8800 | 8300 |
| Tear Resistance, gr | Machine Direction | 1950 | 1800 | 1650 |
| ASTM D1922 | Transverse Direction | 2000 | 1900 | 1750 |

All data generated using 1.5 mil film after 24 hours conditioning at the various relative humidities.

The physical properties of the film are listed below in Table 2.

TABLE 2

| Physical Properties | |
|---|---|
| Melting Point | 200° C. (decomposes) |
| Specific Gravity | 1.27 |
| Water Vapor Transmission (gm/m$^2$/24 hr) | 1200 |

The specifications for the film are listed below in Table 3.

TABLE 3

| Specifications | |
|---|---|
| Film Thickness | 1.5 mil +/− 0.07 |
| Width | 2.0 mil +/− 0.1 |
| | Slit to customer requirements up to 45 inches +/− 1/16 inch |
| Length | 4000 ft per roll of 1.5 mil film |
| | 3000 ft per roll of 2.0 mil film |
| Yield | for 1.5 mil film 15,000 in$^2$/lb |
| | for 2.0 mil film 11,250 in$^2$/lb |

Figure 4:
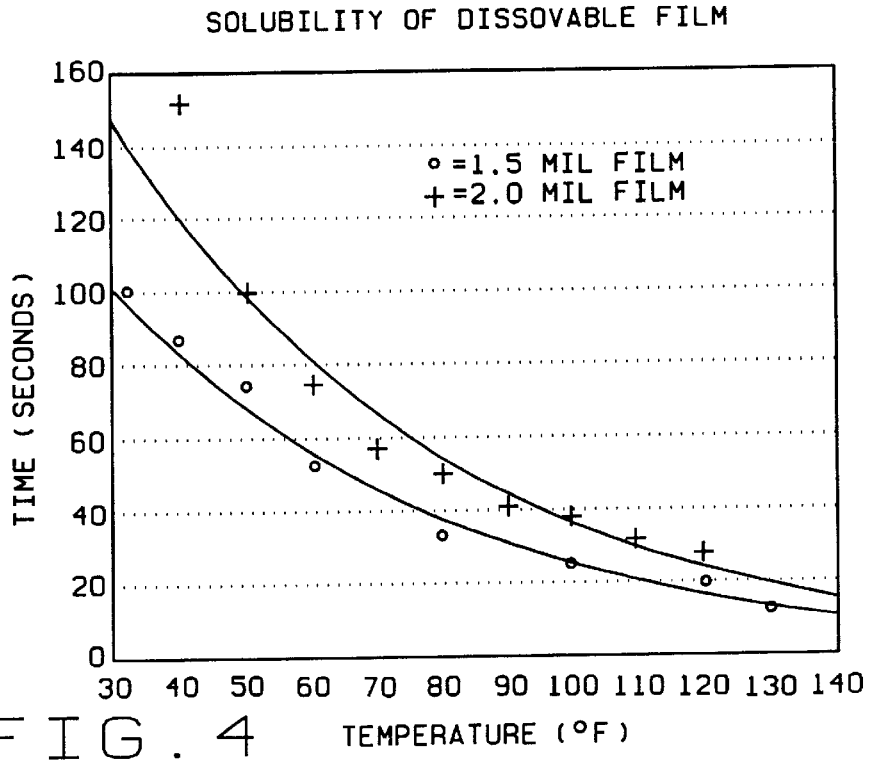
FIG. 4 is graph illustrating the solubility of the dissolvable, printed film.

The QSA 2000 film has a solubility range of 32° to 212° F. but dissolves more quickly in hot water as shown in FIG. 4. As shown in FIG. 4, both 1.5 mil film and 2.0 mil film disintegrate more rapidly as the temperature rises from 30° to 140°. This is of importance to the present invention since it is an object of the present invention to provide a printed film at the center of the bar that will dissolve upon normal use when the bar is used up to the point that the printed film is exposed to warm water. Because the printed film readily dissolves, the printed film does not create a disposal problem and will not block or clog drains or require removal.

The polymer film can be machined, formed and printed using standard industry equipment and is readily printable on commercial printing equipment using water soluble inks. Although the QSA 2000 polymer film described above has proved to function well in this application, any such dissolvable, printable film can be used without departing from the scope of the invention.

Figure 5:
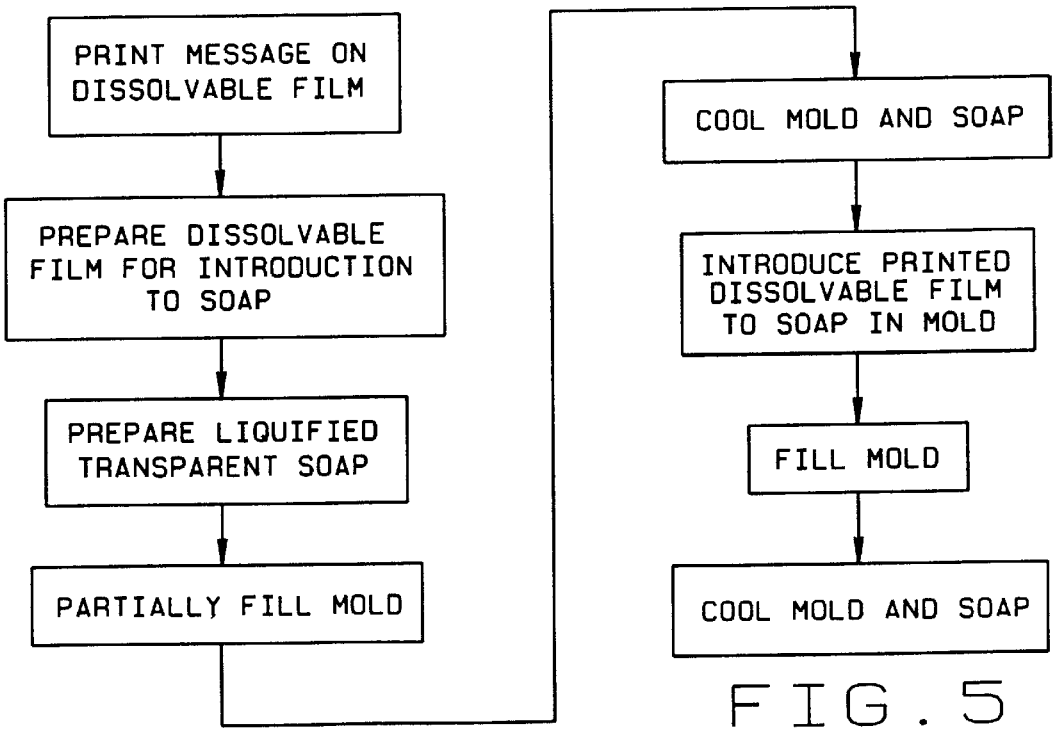
FIG. 5 is a block diagram illustrating the method of making the novel cleansing bar.

The bar 1 is produced in accordance with the steps provided in FIG. 5. First, the polymer film is printed with the desired logo, design or message. As stated above, the film can be printed on large sheets or rolls, as desired. The individual sheets 5 then are prepared by cutting into a plurality of individual sheets 5 from the larger sheet or from the roll. Next, a batch of soap product to form the bar 3 is prepared according to procedures provided in Example 1. Next a mold is placed onto a moving conveyor belt. The mold is designed to produce any desired configuration of soap cake, as discussed above. The mold can be a polyvinyl clam sell mold or a multi-cavity tray made from a silicone compound. The molds travels down the conveyer and trigger a conventional filling mechanism. A piston liquid filler then dispenses a small, predetermined amount of liquid hot soap into the mold to partially or half fill the mold. The mold then travels through a cooling tunnel and exits at the opposite end of the conveyor line where it is placed on a return conveyor which returns it to the front of the line. The partially filled mold then is placed onto the conveyor for a second pass. The printed sheets 5 are placed onto the cooled soap in the mold, generally by hand, and lightly rubbed down. The mold then moves on the conveyor and triggers the filling mechanism so that a remaining, predetermined amount of liquid soap is introduced into the mold, encasing sheet 5. The mold once again moves through the cooling tunnel and exists at the opposite end of the line for packaging.

It will be appreciated that the above procedure produces a bar 1 which has a dissolvable, printed film at the approximate midpoint of the bar. Any message or design printed on the film is readable or viewable without distortion through the transparent bar.

In view of the above, it will be seen that the several objects and advantages of the present invention have been achieved and other advantageous results have been obtained.

It also will be appreciated that the changes or modifications can be made in the soap formulation or the choice of dissolvable, printable film without departing from the scope of the appended claims. Therefore, the foregoing descriptions and accompanying drawings are intended to be illustrative only, and should not be construed in a limiting sense.

I claim:

1. In a transparent cleansing product formed into a cake, the improvement comprising a fast dissolving, hot and cold water soluble colorless and transparent synthetic polymer film with printed matter located within the cake such that substantial portions of the cake are positioned on each side of said synthetic polymer film, said printed matter being viewable through the transparent cake and comprising the only element that is not transparent.

2. In a transparent cleansing product formed into a cake, the improvement comprising a substantially flat and hot and cold water soluble printed colorless and transparent synthetic polymer film positioned within the cake such that substantial portions of the cake are positioned on each side of said synthetic polymer film, said polymer film including a printed indicia viewable through the transparent cake and comprising the only element that is not transparent.

3. A cleansing bar comprising, in combination, a transparent cake of cleansing material and a fast dissolving, hot and cold water soluble transparent synthetic polymer film with printed matter located within the transparent cake such that substantial portions of the cake are positioned on each side of said synthetic polymer film, said printed matter being viewable through the transparent cake and comprising the only element that is not transparent.

4. The cleansing bar of claim 3 wherein the fast dissolving, hot and cold water soluble transparent synthetic polymer film with printed matter is printed with a design.

5. A soap cake bearing an advertising message, comprising:

a transparent soap cake; and a fast dissolving, hot and cold water soluble colorless and transparent, synthetic polymer film with printed matter positioned within said soap cake such that substantial portions of the cake are positioned on each side of said synthetic polymer film, said film soluble in water, wherein the printed matter on said printed, fast dissolving, hot and cold water soluble colorless and transparent, synthetic polymer film stays intact and readable through the soap cake until the soap cake deteriorates, said printed matter comprising the only element that is not transparent.

6. A method of producing a cleansing cake bearing a printed message, comprising:

printing a message on a water soluble, printable transparent synthetic polymer film, said printed water soluble transparent synthetic polymer film being fast dissolving in hot and cold water;

preparing a first part of a liquefied transparent soap;

allowing the first part a liquefied transparent soap to at least partially solidify;

applying the printed water soluble transparent synthetic polymer film on the at least partially solidified first part of the liquefied transparent soap;

preparing a second part of liquefied transparent soap;

applying said second part of liquefied transparent soap to said printed water soluble transparent synthetic polymer film and the at least partially solidified first part of the liquefied transparent soap;

cooling the first and second parts of liquefied transparent soap with the printed water soluble transparent synthetic polymer film therebetween to produce the cleansing cake having a message printed on a hot and cold water soluble, printable transparent synthetic polymer film within the cleansing cake such that substantial portions of the cake are positioned on each side of said synthetic polymer film, said printed message being viewable through the transparent cake and comprising the only element that is not transparent.

7. A transparent cleansing product formed into a clear bar comprising:

Propylene Glycol, approximately 15% to approximately 25%;

70% Sorbitol, approximately 15% to approximately 25%:

Water, approximately 15% to approximately 25%;

Sodium Stearate, approximately 10% to approximately 20%;

Sodium Lauryl Sulfate, approximately 10% to approximately 20%:

Sodium Myristate, approximately 2% to approximately 6%;

Sodium Cocoyl Isethionate, approximately 2% to approximately 6%;

Triethanolamine approximately 0.5% to approximately 3%; and a fast dissolving hot and cold water soluble transparent synthetic polymer film having printed matter positioned within the cake such that substantial portions of the cake are positioned on each side of said synthetic polymer film, said printed matter being viewable through the transparent cleansing product and comprising the only element that is not transparent.

8. A cleansing bar comprising, in combination, a transparent cake of cleansing material and a printed hot and cold water soluble transparent synthetic polymer film located within the transparent cake such that substantial portions of the cake are positioned or each side of said synthetic polymer film, said printed layer bearing a printed indicia, said indicia being viewable through said transparent cake of cleansing material and comprising the only element that is not transparent.

* * * * *

UNITED STATES PATENT AND TRADEMARK OFFICE

CERTIFICATE OF CORRECTION

PATENT NO. : 5,869,437
DATED : February 9, 1999
INVENTOR(S) : Wolfersberger

It is certified that error appears in the above-identified patent and that said Letters Patent is hereby corrected as shown below:

Column 6,
Line 67, replace “flat and hot” with -- flat hot --

Column 7,
Line 40, replace “part a” with -- part of the --

Signed and Sealed this

Thirty-first Day of December, 2002

JAMES E. ROGAN
*Director of the United States Patent and Trademark Office*